United States Patent [19]

van Herten

[11] 4,095,890

[45] Jun. 20, 1978

[54] XEROGRAPHIC COPYING APPARATUS

[75] Inventor: Jozef Marie van Herten, Venlo, Netherlands

[73] Assignee: Océ-van der Grinten N.V., Venlo, Netherlands

[21] Appl. No.: 699,652

[22] Filed: Jun. 24, 1976

[30] Foreign Application Priority Data

Jun. 24, 1975 Netherlands ..... 7507493

[51] Int. Cl.² ..... G03G 15/00

[52] U.S. Cl. ..... 355/14; 355/69

[58] Field of Search ..... 355/3 R, 14, 69

[56] References Cited

U.S. PATENT DOCUMENTS

| | | | |
|---|---|---|---|
| 3,612,682 | 10/1971 | Shelffo et al. | 355/14 |
| 3,661,452 | 5/1972 | Hewes et al. | 355/3 R |
| 3,778,148 | 12/1973 | Fujitsuka et al. | 355/14 |
| 3,826,569 | 7/1974 | Sakamaki | 355/69 X |
| 3,834,807 | 9/1974 | Fuller et al. | 355/3 R |
| 3,960,446 | 6/1976 | Ogawa et al. | 355/3 R |
| 3,997,259 | 12/1976 | Bhagat | 355/3 R |
| 4,017,180 | 4/1977 | Yen et al. | 355/69 |

*Primary Examiner*—William M. Shoop

*Attorney, Agent, or Firm*—Albert C. Johnston; Gerard F. Dunne

[57] ABSTRACT

Development of a charged photoconductive medium in xerographic copying apparatus is prevented when a properly formed charge image is missing as a result of insufficient imagewise exposure, by a system in which the intensity of the exposing illumination is sensed by a detector such as a photoelectric cell or a phototransistor, and when the illumination is below a level sufficient to form a proper charge image a signal emitted by a detector causes a discharging device such as an A.C. corona or a lamp to discharge the charged medium at a location between the exposure station and the developing station of the apparatus. Means also are provided whereby said signal causes interruption of the feeding of copy material to receive an image, and whereby it causes the execution of a preset copy program to be blocked until the exposing illumination is restored to a proper level of intensity. As a further feature of the invention, the discharging device is a light source which normally is operated at a reduced intensity for effecting an integral exposure of the medium to light after the imagewise exposure, and which is switched to full intensity for discharging the medium when the illumination for imagewise exposure is insufficient.

14 Claims, 6 Drawing Figures

XEROGRAPHIC COPYING APPARATUS

This invention relates to a xerographic copying apparatus of the kind in which a photoconductive medium is transported successively past a charging device, an exposing station and a developing station.

Apparatus of that kind is generally known, for instance as shown in U.S. Pat. No. 2,357,809. With the known apparatus, after charging the photoconductive medium the image of an original is projected onto the electrically charged surface to form on it a charge image which is converted into a powder image in the developing station. This powder image is subsequently transferred in a transfer station to a receiving material on which the powder image is fixed, while the photoconductive medium is regenerated for reuse.

If the light source at the exposure station of the known apparatus does not function correctly, for instance because of one of the lamps being defective, or if the feed unit fails, the photoconductive medium will not be discharged imagewise or will be discharged insufficiently. This results in an unusable image being produced in the developing station, which image shows either a black surface or dark background portions, but it is also particularly detrimental to the regeneration of the photoconductive medium. The reason is that, following the transfer of the powder image to the receiving material in the transfer station, a residual image is left on the photoconductive medium to be removed by a cleaning device which forms part of the regeneration device. Depending upon the transfer method used, the residual image represents 5 to 30 percent of the weight of the original powder image.

It has been observed that when a photoconductive medium is not exposed after being charged, the quantity of powder transferred onto the photoconductive medium in the developing station is 20 to 30 times greater than in the case of a normal imagewise exposure. Consequently, any image residue left on the medium will be 20 to 30 times heavier, so that either the cleaning device must have been adapted to overcome these extreme conditions or the service life of the photoconductive medium, i.e., the number of copies that can be made with it, decreases considerably.

The object of the present invention is to provide in a xerographic copying apparatus a system by which the disadvantages above mentioned are prevented.

According to the invention this object is attained by providing the apparatus with at least one detector which senses the intensity of the illumination resued by the means, including at least one light source, that serve for exposing the original and thus forming the charge image in the productive medium at the exposure station, which detecting means emits a signal when the illumination intensity is below a lever sufficient to form a proper charge image, together with a discharging device which acts on the charged photoconductive medium in response to said signal, at a location between the exposure station and the developing station, so as to discharge the medium and thus prevent development if the medium is improperly exposed or is not exposed at all.

In this way, the already charged photoconductive medium is discharged again if the exposing means does not function at all or does not function correctly, so that no powder is attracted by the photoconductive medium in the developing station. As a result, it suffices to use a cleaning device of less robust construction, enabling the cleaning device to be simpler and less costly and the service life of the photoconductive medium may be increased.

The detector or detectors mentioned may each be a light-sensitive element, such as a photocell or a phototransistor, that responds to the light emitted by the light source, or may be an element that responds to the electric current through the light sources.

According to a further feature of the invention, the copying apparatus is provided with a means whereby the supply of receiving material to the transfer station, where the image is transferred from the photoconductive medium onto a receiving material, is temporarily interrupted when the discharging device is activated. Consequently, there is no needless supply or waste of receiving material.

A further feature of the invention as applied to a copying apparatus provided with a program switch for selecting the number of copies to be made from an original, consists in that means are provided for interrupting the execution of the copy program when the discharging device is activated, and until the exposure again functions normally.

A particularly advantageous embodiment of the invention is obtained when the exposure of the photoconductive medium after charging is divided into an integral exposure and an imagewise exposure, as described e.g. in British patent specification No. 1,284,887, and the discharging device is constituted by a lamp. It has been found that the integral exposure can be effected satisfactorily after the imagewise exposure, by means of a lamp operated at reduced capacity, and this same lamp can serve for discharging the medium by being switched to full capacity if there is a failure of or an improper imagewise exposure. The effect obtained by applying imagewise exposure first and integral exposure subsequently does not appear to differ significantly from the effect obtained by applying integral exposure first and imagewise exposure subsequently as described in said British patent specification.

The above mentioned and other features and advantages of the invention will be apparent from the following description and the accompanying drawings of illustrative embodiments of the invention. In the drawings.

Figure 1:
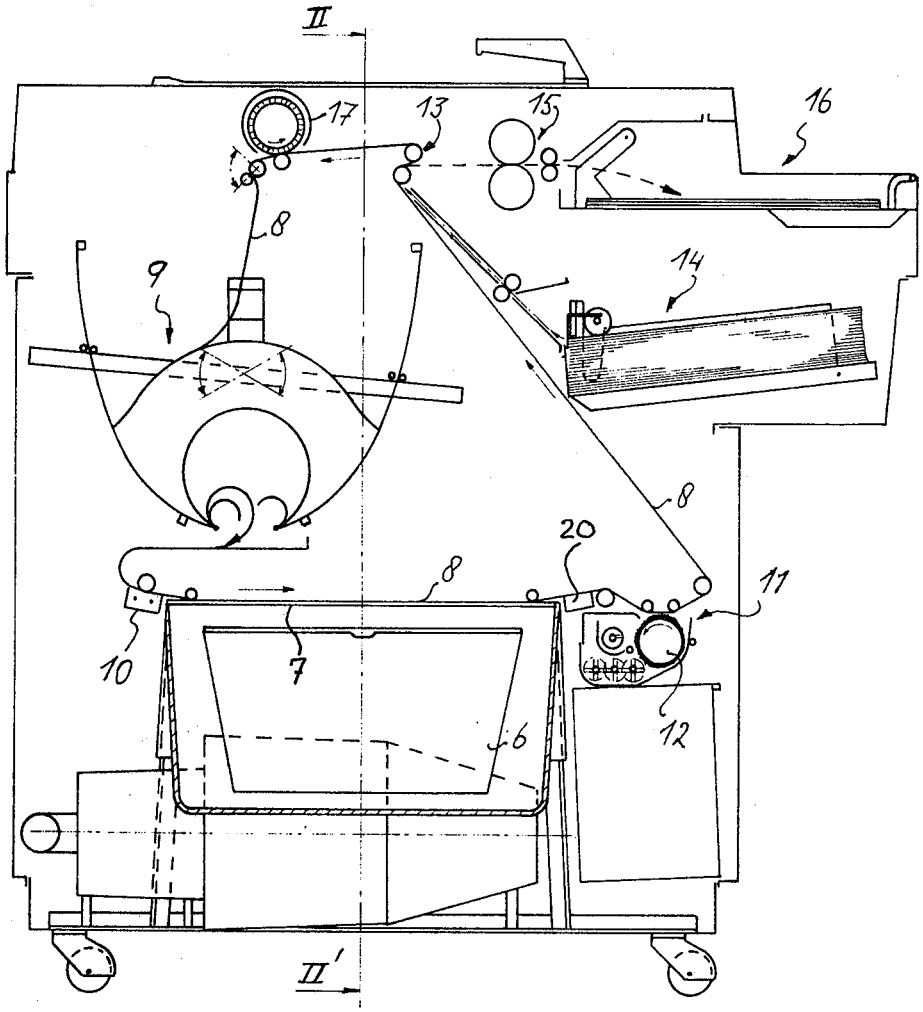
FIG. 1 is a schematic sectional view of an electrophotographic apparatus provided with means for discharging the photoconductive medium according to the invention.
Figure 2:
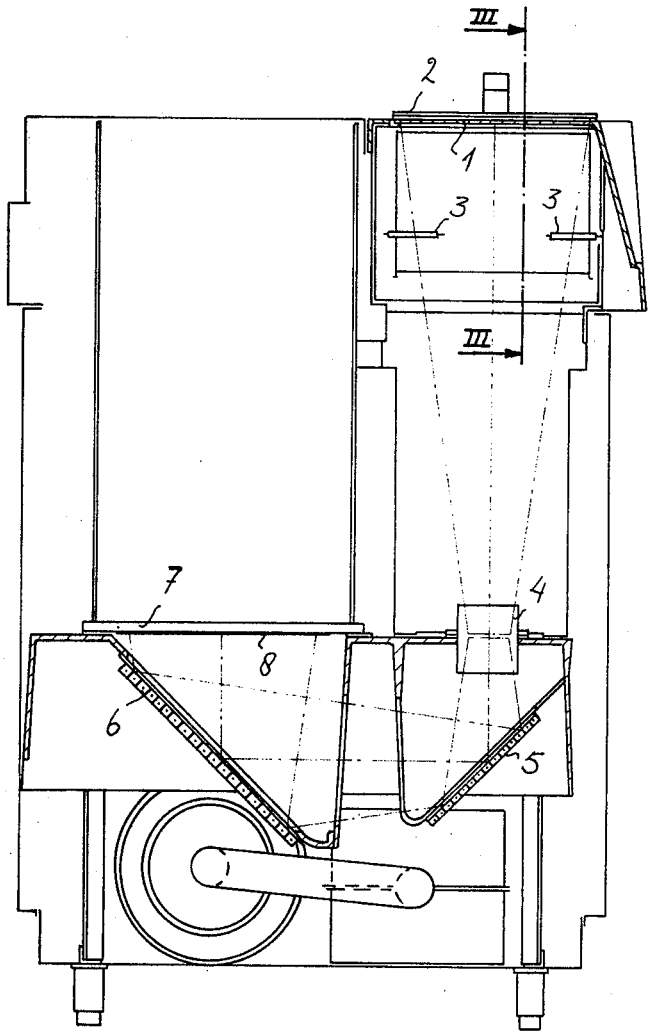
FIG. 2 is a section taken along line II—II of FIG. 1.

The various parts of a copying apparatus in which the invention can be utilized to advantage are represented schematically in FIGS. 1 and 2.

In the apparatus there shown, an original to be copied is laid on a transparent glass plate 1 and pressed down against the glass plate by a cover 2, and then is exposed by means of four flashlamps 3. The image reflected by the original is projected, via an optical system consisting of a lens 4 and mirrors 5 and 6, onto a part of the photoconductive medium 8 present in the projection station 7, which photoconductive medium is an electrophotographic element or plate in the form of an endless belt.

The endless belt 8 is transported in the apparatus via a number of rollers, with an interposed period of storage of a length of the belt in a magazine 9, according to the system described in U.S. Pat. No. 3,926,625. The length of the belt extending from and back to the magazine is moved with a constant speed in the direction of the arrows.

The photoconductive layer of the belt is charged before exposure, by a corona charging device 10. The projected light image discharges the parts of the photoconductive layer struck by the light, forming on the belt a latent electrostatic image which corresponding with the original. Upon further moving of the belt the latent electrostatic image passes a developing station 11, where developing powder is brought into contact with the belt surface with the aid of a so-called magnetic brush 12, in order to develop the latent image and convert it into a powder image.

The power image in transported by the belt to a transfer station 13, where it is brought into contact with a sheet of copy paper that is moved forward with the same speed as the belt and onto which the powder image is transferred, for instance by applying a suitable electric field. A sheet feeding device 14 is provided for transporting copy sheets individually and successively into contact with the belt in the transfer station.

The sheet that receives the powder image is separated from the belt 8 at the transfer station and passed through a fixed device 15 by which the transferred powder image is fixed onto the sheet of copy paper. Then the sheet is passed into a receiving tray 16 opening outside of the apparatus.

Any part of the power image which is not transferred to the sheet of copy paper is transported beyond the transfer device 13 with the belt 8 and past a cleaning device 17 by which the residual powder is removed.

The copying apparatus further comprises suitable drive means and guide means for driving the belt 8 in timed relationship with the flash exposure of an original to be copied, for separating and supplying sheets of copy paper and transporting these through the transfer device 13, and for transporting a sheet of paper through the fixing device 15 to the receiving tray 16.

The above description is illustrative of the general operation of a type of electrostatic copying apparatus in which the present invention can be utilized to advantage. The invention, however, may also be utilized for other forms or types of apparatus of the kind first mentioned hereinabove.

According to the invention, a discharging device 20 is provided adjacent to the transport path of the photoconductive belt at a location between the projection station or exposure plane 7 and the developing device 11. The discharging device 20 may be, for example, an A.C. corona discharging device or a light source such as a glow lamp.

Figure 3:
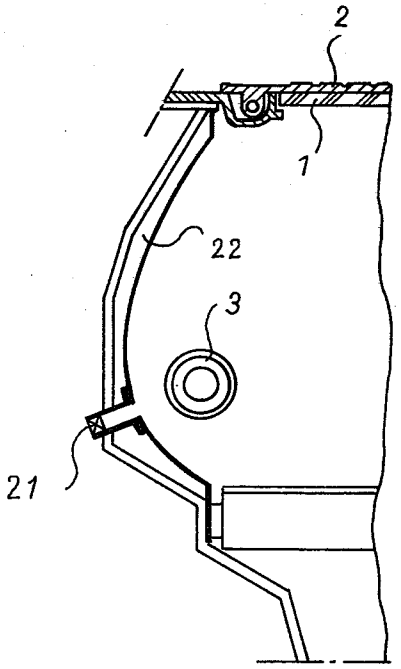
FIG. 3 is a partial section, at enlarged scale, taken along line III—III of FIG. 2.

Further, at least one detector 21 for sensing the functioning of the lamps 3 is installed according to the invention in the exposing station (see FIG. 3). When the detector utilized is a photocell or photoresistor, it may be installed, for instance, beside the lens 4 or beside the glass plate 1. In the embodiment illustrated, in which four flash lamps 3 are used for the exposure and each lamp is provided with a reflector 22, a detector 21 is provided for each lamp and is installed in a part of pertaining reflector 22 at a location where the reflector is considered as ineffective because the rays reflected by that part of it do not or only slightly expose the glass plate 1, being mainly absorbed by the lamp 3 itself.

The discharging device 20 and the detector or detectors 21 are electrically coupled in a manner dependent upon the manner of operation of the copying apparatus. A preferred manner of coupling them is described below in more detail. In any case, the electric coupling is such that, upon insufficient exposure of the glass plate because one of the lamps does not function or functions badly, so that the corresponding portion of of an original on the exposure plate 1 and, consequently, the belt 8 is exposed insufficiently, the charge on that portion of the belt 8 is neutralized fully by means of the discharging device 20 when the relevant belt portion moves past this device.

Figure 4:
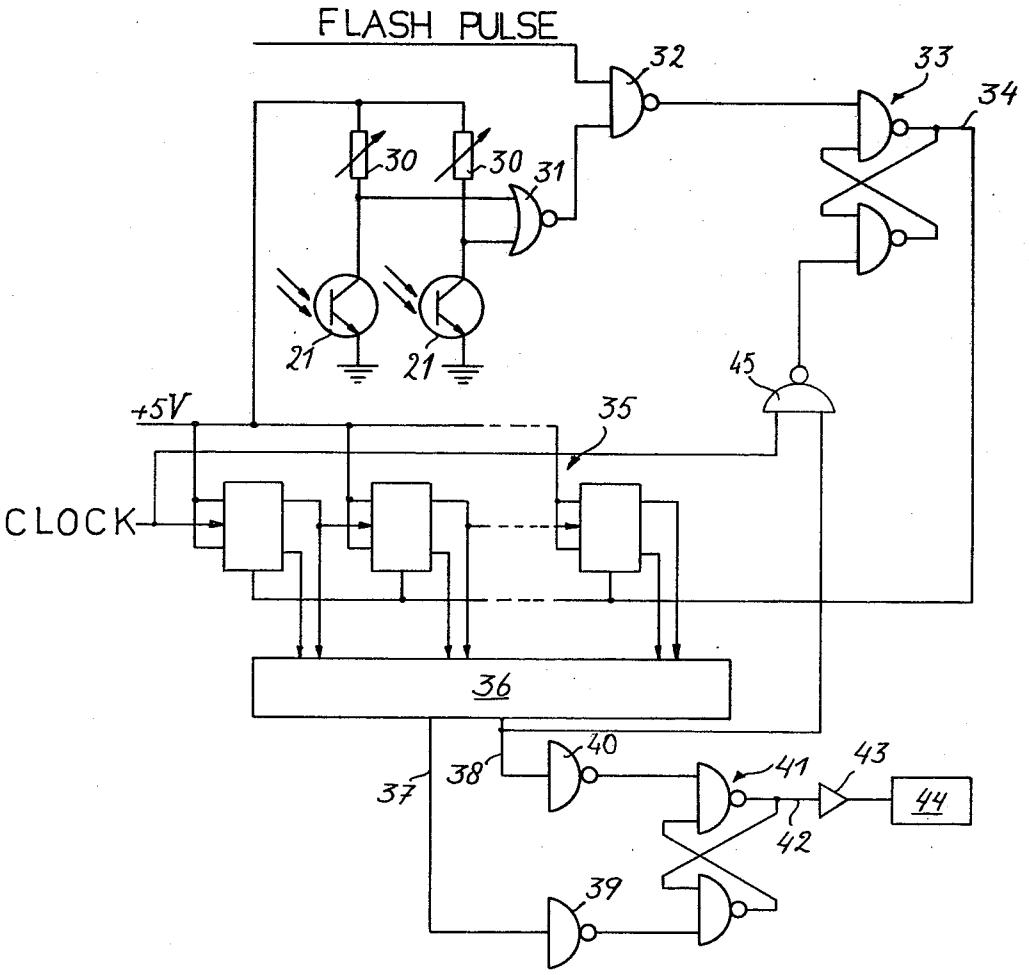
FIG. 4 is a diagram of a circuit for coupling the detector with the discharging device.

The means coupling the discharging device and the illumination detector or detectors may form part of or may be included in the electric control circuit of the copying apparatus. FIG. 4 shows a circuit for coupling two detectors 21 (one for each pair of flashlamps) with a discharging device 20, which circuit is suitable for being connected with the control circuit described in detail in U.S. Pat. No. 3,912,390.

As described in U.S. Pat. No. 3,912,390, when making one copy the corona charging device 10 is switched on and off. At a certain moment after charging up, namely, when the charged part of the photoconductive belt 8 has arrived in the exposure plane, a flash pulse is formed, as a result of which the lamps 3 emit a light flash.

In the circuit of FIG. 4, the detectors 21 are each connected in series with a potentiometer 30 which is connected with the +5V terminal of a voltage supply source. When light falls upon a detector 21, the detector becomes conductive and a voltage decrease occurs over the potentiometer 30, so that the voltage in the connection lead between 30 and 31 becomes lower than +5V. Each connection lead is connected with one of the inputs of a NOR-gate 31, so that when sufficient light falls on all detectors 21, a signal pulse is formed in the output of the NOR-gate 31. By means of the potentiometer 30 it is possible to adjust the minimum intensity of light required to generate an effective signal in the inputs of the NOR-gate 31.

The flash pulse already mentioned and the signal of the NOR-gate 31 are combined in a NAND-gate 32, the output of which temporarily becomes zero when the detectors 21 have registered sufficient light. This temporary zero condition of the output of the gate 32 is used for setting a flipflop 33, the output 34 of which is used for opening a counter 35. This counter 35 is built up of a number of JK-flipflops, for instance of the type Texas Instruments SN 7473, the functioning of which is generally known. The clock input of this counter is connected with the pulse counter described in the above mentioned U.S. Pat. No. 3,912,390. After the counter 35 has been opened via a signal of the flipflop 33, these pulses are counted. The outputs of counter 35 are connected with a decoding circuit 36 which is adjusted on two fixed numbers A and B. These numbers are so chosen that when the number A is reached in the counter 35, the leading edge of the charged part of the belt reaches the discharging device 20, and when the number B is reached in the counter 35 the trailing edge of the charged part of the belt has passed the discharging device 20.

When in the counter 35 the number A is reached, a signal pulse is generated in the output 37 of the decoding circuit 36. The output 37 is connected via an invertor 39 with the reset input of a RS-flipflop 41. When the number B is reached in the counter 35, a signal pulse is generated in the output 38 of the decoding circuit 36. The output 38 is connected via an invertor 40 with the set input of the flipflop 41. The output 42 of the flipflop 41 is connected via an amplifier 43 with a switching element 44, with which the discharging device 20 can be switched on and off.

In normal conditions, so at satisfactory functioning of the exposure lamps, the operation of the device is as follows:

At the moment when a flash pulse is generated, the lamps ignite, so that at the same time the phototransistors 21 are exposed and consequently become conductive. In the output of the NOR-gate 31 a signal pulse is generated which is combined with the flash pulse in the NAND-gate 32, in the output of which a signal pulse is generated. By this signal pulse the flipflop 33 is set so that in the output 34 a signal is generated, by which the counter 35 is opened.

As soon as the number A is reached in the counter 35, a signal pulse is generated in the output 37 of the decoding circuit 36, which signal pulse resets the flipflop 41 via the invertor 39, so that in the output 42 no signal is present. Thus the switching element 44 is no longer excited and the discharging device 20 is switched off. As soon as the counter 35 has reached the number B, a signal pulse is generated in the output 38 of the decoding circuit 36, which pulse sets the flipflop 41 via the invertor 40. A signal is thus generated in the output 42, which signal re-excites the switching element 44 via the amplifier 43. The output 38 is also connected with a NAND-gate 45, which is also connected with the clock pulse generator, so that when the number B is reached, the flipflop 33 is reset, whereby the counter 35 is reset and is blocked.

In case one of the phototransistors 21 is not exposed or is exposed insufficiently, no signal is generated in the output of the gate 31, so that the counter 35 cannot be opened, which means that the discharging device 20 keeps working and the photoconductive belt is fully discharged.

Figure 5:
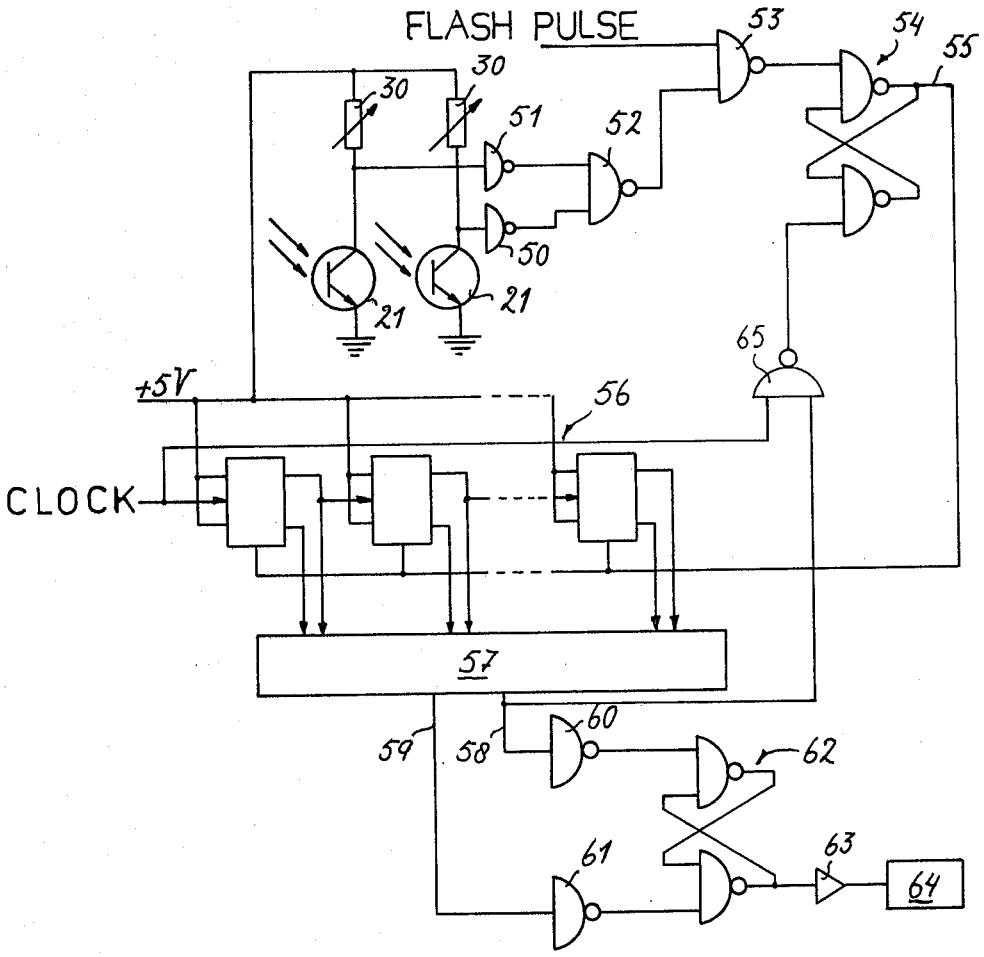
FIG. 5 is a diagram of a modification of the circuit of FIG. 4.

FIG. 5 shows a second embodiment of a circuit suitable for coupling the detectors 21 and the discharging device 20, by which circuit the discharging device 20 is activated only when this is necessary.

Just as in the circuit of FIG. 4, the detectors 21 are each connected in series with a potentiometer 30. Each connection lead is connected with an invertor 50 or 51, the outputs of which are combined in a NAND-gate 52. The gate 53, the flipflop 54, the counter 56 and the decoding circuit 57 corresponding respectively to the elements 32, 33, 35 and 36 of the circuit of FIG. 4. A signal is generated in the output 59 of the decoding circuit 57 when the counter reaches the number A, and a signal is generated in the output 58 of the decoding circuit 57 when the counter reaches the number B. Via the invertors 60, 61, a flipflop 62 and an amplifier 63 these signals can be used for switching the discharging device 20 on and off via the switching element 64.

In normal conditions, so at satisfactory functioning of the exposure lamps, the operation of the device is as follows:

At the moment when a flash pulse is generated, the lamps ignite, so that at the same time the phototransistors 21 are exposed and thus become conductive. Thus the generation of a signal (a U-shaped signal pulse) in the output of the gate 52 is temporarily interrupted, so that the gate 53 is blocked and nothing further happens. The discharging device 20 continues to be switched off.

When at least one of the detectors 21 is not exposed or is exposed insufficiently, the output of the gate 52 continues to be high, so that the flash pulse is transmitted by the gate 53, and the flipflop 54 is set; so the counter 56 is opened via the output 55. When the number A is reached, a signal is generated in the output 59 of the decoding circuit 57, which signal sets the flipflop 62 via the invertor 61, whereby the switching element 64 is excited via the amplifier 63 and the discharging device 20 is switched on. When the number B is reached, the flipflop 62 is reset via the output 58 and the invertor 60; so the excitation of the switching element 64 is stopped, and the discharging device 20 is switched off. At the same moment the flipflop 54 is reset via the NAND-gate 65, by which the counter 56 is reset and blocked.

A coupling circuit of the type described above can also be provided in other ways. For instance, instead of the flipflop 33 or 54, the counter 35 or 56 with decoding circuit 36 or 57 and the flipflop 41 or 62, two parallel-switched delaying elements can be used, which cause signal delays in proportion to the numbers A and B, whereby the switching element 44 or 64 is connected with these delaying elements and is switched off or on via the delaying element A, and is switched on or off via the delaying element B.

The signal which is generated when at least one of the exposing lamps does not function, or functions insufficiently, can also be used to advantage according to the invention for protecting other functions of the copying apparatus, especially the feeding in of copy sheets and the execution of a copy count by a program control switch. This is an advantageous feature in that, as will be apparent, if the discharging device has functioned in the safety system and nothing further happens, yet a sheet of copy paper is transported through the transfer station and the fixing device, a blank sheet will be delivered as a copy from the apparatus, and it will be counted as a copy.

Figure 6:
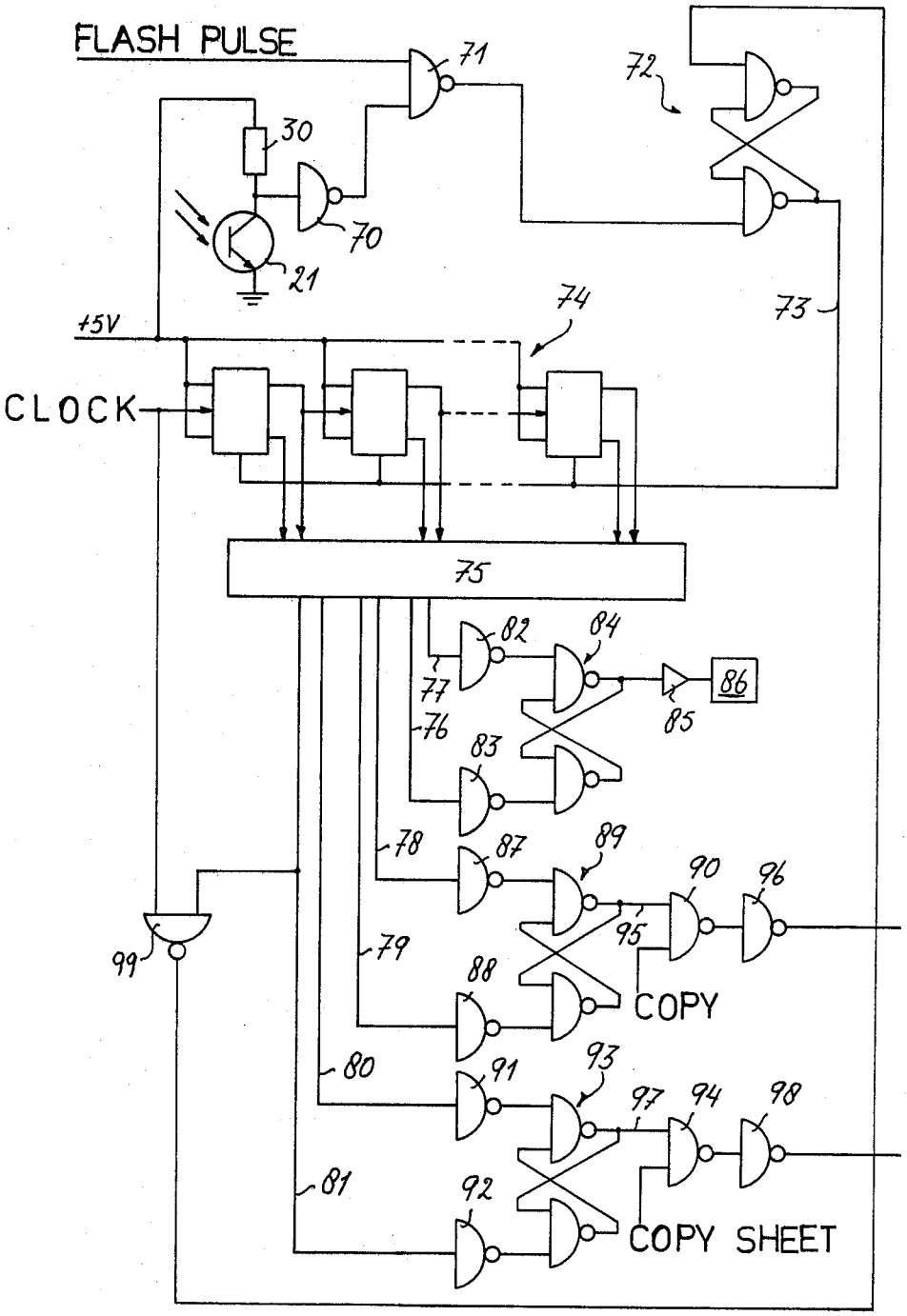
FIG. 6 is a diagram of a further modification of the circuit of FIGS. 4 and 5.

An electric circuit with which such delivery of a blank copy sheet can be prevented is shown in FIG. 6. By this embodiment, not only the protective function of the discharging device 20 is achieved but also, after the exposing lamps have not functioned at all or have functioned insufficiently, the introduction of a copy sheet and counting of this sheet as a copy by the program switch are prevented.

In the embodiment of FIG. 6 it is presupposed that the discharge device is to be normally and continuously excited, as in the first described embodiment, and further that a signal referred to hereinbelow as a "copy sheet" signal is generated in the apparatus at a certain moment, by which signal a sheet of paper is caused to arrive at an exact moment in the transfer station, and a "copy" signal is then excited which is led to the program switch and causes it to register that a copy is coming or has been made. These signals can be formed, for instance, as described more particularly in the said U.S. Pat. No. 3,912,390. Further it is supposed for purposes of the circuit shown that only one detector is used in the exposure station.

The detector 21 is connected in series with a potentiometer 30, and their connecting lead is connected via an invertor 70 with a NAND-gate 71 to which the flash pulse is also supplied. The output of the gate 71 is connected with the set input of an RS-flipflop 72, the output 73 of which is used for opening a counter 74 the outputs of which are connected with a decoding circuit 75. All this is as described in relation to FIG. 4

The decoding circuit in the embodiment of FIG. 6 is set on six numbers A, B, C, D, E and F. The numbers A and B have the same significance as described above with relation to FIGS. 4 and 5. The numbers C and D correspond with the moments at which, in normal operation of the apparatus, the "copy" signal starts or ends, whereas the numbers E and F correspond with the moments at which, in normal operation of the apparatus, the "copy sheet" signal starts or ends.

When the numbers A, B, C, D, E and F are reached, signals are respectively generated in the outputs 76, 77, 78, 79, 80 and 81. The outputs 77 and 76 are connected via respective invertors 82 and 83 with respectively the reset and set inputs of the flipflop 84, the output of which is connected via an amplifier 85 with a switching element 86 for switching the discharging device 20 on and off, all as described with relation to FIG. 4.

The output 78 is connected via an invertor 87 with the set input of a flipflop 89, the reset input of which is connected via an invertor 88 with the output 79 of the decoding circuit 75. The output 95 of the flipflop 89 is combined with the "copy" signal in a NAND-gate 90 so that the "copy" signal is blocked when no signal is present in the output 95. NAND-gate 90 is connected with the program switch via an invertor 96.

The output 80 is connected via an invertor 91 with the set input of a flipflop 93, the reset input of which is connected via an invertor 92 with the output 81 of the decoding circuit 75. The output 97 of the flipflop 93 is combined with the "copy sheet" signal in a NAND-gate 94, so that the gate 94 blocks the "copy sheet" signal when no signal is present in the output 97. The gate 94 is connected via an invertor 98 with the sheet feed-in mechanism.

The output 81 of the decoding circuit 75 also is combined in a NAND-gate 99 with the clock pulse, and the output of the gate 99 is connected with the reset input of the flipflop 72. Hereby it is accepted that the number F is the greatest of the six numbers A to F.

The normal operation of the system is as follows, under conditions existing when the exposure functions correctly. The phototransistor 21 becomes conductive, so that the gate 70 generates a signal pulse which is combined in the gate 71 with the flash pulse, by which the flipflop 72 is set and the counter 74 is opened via the output 73. When the number A is reached, a signal is generated in the output 76, which signal resets the flipflop 84 via the invertor 83, so that in its output no signal is present and the discharging device 20 is switched off via the amplifier 85 and the switching element 86. Subsequently the number B is reached in the counter, causing a signal by which the flipflop 84 is set via the output 77 and the invertor 82, and the discharging device 20 is again excited. When the number C is reached, the signal sets flipflop 89 via the output 78 and the invertor 87, and the gate 90 is opened, so that the "copy" signal is transmitted. The flipflop 89 is reset via the output 79 and the invertor 88, when the number D is reached. When the number E is reached, the flipflop 93 is set via the output 80 and the invertor 91 and a signal is generated in the output 97, which signal opens the gate 94 so that the "copy sheet" signal is transmitted. The flipflop 93 is reset via the output 81 and the invertor 92 when the number F is reached.

When the number F is reached, a signal pulse also is generated in the output 81 connected with the gate 99, so that the flipflop 72 is reset via the gate 99 and the counter 74 is thus reset and blocked.

When the exposure does not function correctly, the flipflop 72 is not set, and the counter 74 therefore stays blocked. Consequently the gates 90 and 94 are also kept blocking, and the "copy" and "copy sheet" signals are not transmitted.

It will be apparent that other functions in the apparatus can also be protected in the same way, such, for example, as the application of voltage in the transfer station and the switching-on of the developing device. Further it is obvious that the circuit arrangement of FIG. 6 can easily be changed into one suited for the use of a discharging device that does not operate uninterruptedly.

Another advantageous application of the invention is found in connection with the principle described in British patent specification No. 1,284,887, in which it is proposed that the photoconductive medium, after having been charged, be first exposed integrally with limited intensity and subsequently exposed imagewise, in order thus to influence the gradation of the image formed. It has been found that it makes no difference in this regard if the integral exposure with limited intensity takes place after, instead of before, the imagewise exposure has taken place. Accordingly, when a light source is employed as a discharging device according to the present invention, this light source can serve for discharging the photoconductive medium, by being switched to its full illuminating capacity, or for effecting the integral exposure with limited intensity by being switched to operate at a suitable reduced capacity. In this case the switching element 44, 64 or 86 of a circuit such as that of FIG. 4, 5 or 6 is used for switching the light source to full capacity or to reduced capacity.

The invention of course is not restricted to the particular embodiments described and illustrated in the drawings, as numerous modifications can be employed, and especially so in relation to the circuit between an exposure detector such as detector 21 and a device for discharging the photoconductive medium, such as device 20, while still employing the principle of this invention.

What is claimed is:

1. In a xerographic copying apparatus comprising a photoconductive imaging medium movable along a processing path having in succession therealong a device for charging said medium, a station for exposure of the charged medium to form a charge image thereon, and a station for developing the charge image, and exposing means including at least one light source for illuminating an original and thereby imagewise illuminating the charged medium at said exposure station, the improvement which comprises means for detecting the intensity of the illumination issued by said exposing means and for emitting a signal when said intensity is below a level sufficient to form on the charged medium a charge image properly developable at said developing station, and means responsive to said signal for discharging the charged medium at a location in said path between said exposure station and said developing station, thereby preventing development if a proper charge image is missing.

2. Apparatus according to claim 1, said detecting and signal emitting means including at least one photoelectric element located in a path of light from said light source.

3. Apparatus according to claim 2, said photoelectric element being a photo-electric cell or a photo transistor.

4. Apparatus according to claim 1, said means for discharging said medium including a discharging device mounted at said location, means normally keeping said discharging device active when said medium is being moved along said path, and means responsive to said detecting and signal emitting means for inactivating said discharging device when said illumination intensity is at a level sufficient to form a properly developable charge image on the charged medium.

5. Apparatus according to claim 4, said discharging device being an A.C. corona or a light source.

6. Apparatus according to claim 1, said means for discharging said medium including a discharging device mounted at said location, said discharging device normally being inactive, and means responsive to said signal for activating said discharging device.

7. Apparatus according to claim 6, said discharging device being an A.C. corona or a light source.

8. Apparatus according to claim 1, and further comprising means at a transfer station in said path for supplying to said medium material for receiving a developed image by transfer from said medium, wherein said improvement further comprises means responsive to said signal for temporarily rendering said material supplying means inoperative.

9. Apparatus according to claim 1 and further comprising a control circuit including a program switch settable for determining the number of copies to be made of an original, wherein said improvement further comprises means responsive to said signal for blocking the execution of a copy program set in said program switch until said illumination intensity is restored to said sufficient level.

10. Apparatus according to claim 1, said improvement further comprising means for integrally exposing said medium to light of reduced intensity after the imagewise illumination but before development of the charge image, said means for discharging said medium being a light source mounted at said location, and means for normally operating said discharging light source at a reduced intensity, whereby the same light source serves normally as said means for integrally exposing said medium and serves in response to said signal for discharging said medium.

11. In a xerographic copying apparatus comprising a photoconductive medium movable along a processing path having in succession therealong a device for charging said medium, a station for exposure of the charged medium to form a charge image thereon, a station for developing the charge image into a powder image and a transfer station having thereat means for supplying to said medium material for receiving the powder image by transfer from said medium, exposing means including at least one light source for illuminating an original and thereby imagewise illuminating the charged medium at said exposure station, and a control circuit including a program switch settable for determining the number of copies to be made of an original, the improvement which comprises means including at least one photo-electric element located in a path of light from said light source for sensing the intensity of the illumination issued by said exposing means and for emitting a signal when said illumination intensity is below a lever sufficient to form on the charged medium a charge image properly developable at said developing station, means responsive to said signal and including a light source at a location between said exposure station and said developing station for discharging the charged medium and thereby preventing development thereof when a proper charge image is missing, and respective means responsive to said signal for temporarily rendering said material supplying means inoperative and for blocking the execution of a copy program set in said program switch until said illumination intensity is restored to said sufficient level.

12. Apparatus according to claim 11, and means for normally operating said discharging light source at a reduced intensity whereby the same light source serves normally as a means for integrally exposing said medium to light of reduced intensity after the imagewise illumination but before development of the charge image and serves in response to said signal for discharging said medium.

13. Apparatus according to claim 1, said exposing means including a plurality of lamps arranged at different locations for illuminating an original to be copied, said detecting and signal emitting means including a plurality of light sensitive elements each of which is located in a direct path of light from at least one of said lamps and is operative to produce first and second circuit conditions, respectively, when the intensity of light from the related lamp or lamps is below and above a required level, and means responsive to the presence of a said first signal condition in any of said elements for activating said discharging means.

14. Apparatus according to claim 13, each of said lamps having a reflector adjoint thereto for reflecting light from the lamp toward the original, each of said reflectors having one of said light-sensitive elements mounted therein at a location therein from which light from the lamp is not reflected to the original.

* * * * *

UNITED STATES PATENT OFFICE

CERTIFICATE OF CORRECTION

Patent No. 4,095,890 Dated June 20, 1978

Inventor(s) Jozef M. van Herten

It is certified that error appears in the above-identified patent and that said Letters Patent are hereby corrected as shown below:

Column 1, line 51: in place of "resued" read -- issued --.
line 54: "productive" read -- photoconductive --.
line 56: "lever" read -- level --.
Column 3, line 14: in place of "corresponding" read -- corresponds --.
line 35: in place of "power" read -- powder --.
Column 4, line 11: delete the second occurrence of "of".
Column 10, line 15: in place of "lever" read -- level --.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*